United States Patent [19]

Rich et al.

[11] Patent Number: 4,895,072

[45] Date of Patent: Jan. 23, 1990

[54] VIBRATION DAMPING DEVICE FOR ROTATING CYLINDERS

[75] Inventors: Gerard Rich, Soultz; Bertrand Felly, Bollwiller, both of France

[73] Assignee: Rollin, S.A., Steinbach, France

[21] Appl. No.: 159,472

[22] Filed: Feb. 16, 1988

Related U.S. Application Data

[63] Continuation of Ser. No. 921,977, Oct. 22, 1986.

[30] Foreign Application Priority Data

Oct. 28, 1985 [FR] France ..... 85 15995

[51] Int. Cl.[4] ..... B41F 13/08

[52] U.S. Cl. ..... 101/376; 101/216; 101/217; 101/415.1

[58] Field of Search ..... 101/216, 217, 376, 415.1

[56] References Cited

U.S. PATENT DOCUMENTS

| | | | |
|---|---|---|---|
| 2,447,991 | 8/1948 | Stempel | 101/217 |
| 3,453,955 | 7/1969 | Seel et al. | 101/216 |
| 3,795,568 | 3/1974 | Rhodarmer et al. | 101/376 X |
| 4,286,827 | 9/1981 | Peterson et al. | 308/26 |
| 4,332,194 | 6/1982 | Gensheimer | 101/216 |
| 4,341,157 | 7/1982 | Simeth | 101/375 |
| 4,452,143 | 6/1984 | Heinemann et al. | 101/415.1 X |

FOREIGN PATENT DOCUMENTS

| | | |
|---|---|---|
| 2945280 | 10/1980 | Fed. Rep. of Germany . |
| 3012060 | 10/1981 | Fed. Rep. of Germany . |
| 806357 | 12/1936 | France . |
| 1281685 | 12/1961 | France . |
| 1461067 | 10/1966 | France . |
| 1561224 | 2/1969 | France . |
| 2407847 | 6/1979 | France . |
| 2467323 | 10/1980 | France . |
| 2548134 | 6/1983 | France . |

*Primary Examiner*—Edgar S. Burr
*Assistant Examiner*—Ren Yan
*Attorney, Agent, or Firm*—John Dana Hubbard; William L. Baker

[57] ABSTRACT

A damping device for reducing vibration, particularly cylinder bounce in rotating cylinders, such as printing cylinders. The damping device is a multilayered insert of elastomeric and rigid materials. The layers are preferably laminated together and more preferably the elastomeric and rigid layers are alternated throughout the damping device. The insert is located in a housing on the cylinder so as to be flush with the cylinder's outer surface. The damping device may have variable damping abilities formed by the selection of materials, location of materials and/or the use of filled orifices of different damping material in the inserts.

2 Claims, 3 Drawing Sheets

VIBRATION DAMPING DEVICE FOR ROTATING CYLINDERS

This is a continuation of co-pending application Ser. No. 921,977, filed on Oct. 22, 1986.

The present invention relates to a damping device for damping the vibrations in rotating cylinders. Most notably, the present invention relates to a damping device for use on plate and blanket cylinders in printing presses.

BACKGROUND OF THE INVENTION

The problem of streaked or scratched printed material is well known to printers, especially those using offset printing machines.

Those streaks are caused by a phenomenon known as "cylinder bounce". Cylinder bounce is a mechanical vibration in cylinders and the surrounding support structure which occurs when the gap or gaps in the cylinders touch the adjoining cylinder. These vibrations cause pressure variations in the printing nip area which affects the quality of the printing, causing streaks and scratches and affects the machine life, causing unnecessary and accelerated wear to the cylinders, their supportive mechanisms such as journals and bearings and other associated portions of the machine. Cylinder bounce is more pronounced at higher printing speeds and therefore limits the productivity of the machines.

OBJECTS AND SUMMARY OF THE INVENTION

It is an object of the present invention to reduce or eliminate cylinder bounce in rotating cylinders having one or more gaps, particularly in cylinders of printing machines.

It is another object of the present invention to provide a means for reducing or eliminating cylinder bounce through the use of one or more damping means attached to the cylinders.

A further object is to provide a damping means on clinders in the areas adjacent the front and/or rear edge of the gaps.

An object of the present invention is to provide a damping means of laminated layers wherein the alternating layers are made of resilient materials and rigid materials.

A further object of the present invention is to provide a series of damping means on a cylinder to absorb and damp the vibrations caused by the gap on that cylinder or on an adjacent cylinder.

Another object of the present invention is to provide a series of damping means spaced axially and/or circumferentially along the edge of the gap.

A further object of the present invention is to provide damping means on an arc of about 5° to 20°, preferably in the order of about 10° to 15°, adjacent the edge of the gap.

A further object of the invention is to provide damping means with an axially or circumferentially variable damping ability.

An object of the present invention is to provide variable damping abilities to the damping means by the use of orifices of different sizes and damping abilities.

The present invention is a damping means for reducing the vibration in rotating, adjacent cylinders comprising one or more multilayered damping means of elastomeric layers and rigid layers located along the outer circumferential edge of the cylinder, preferably adjacent the front and rear edge of the gap. The damping means may have a variable damping ability formed by either the components and location thereof in the damping means or through the insertion of additional damping materials in orifices throughout the damping means.

Other purposes, features and advantages of the invention will appear clearly from the following description, drawings and claims.

Figure 4:
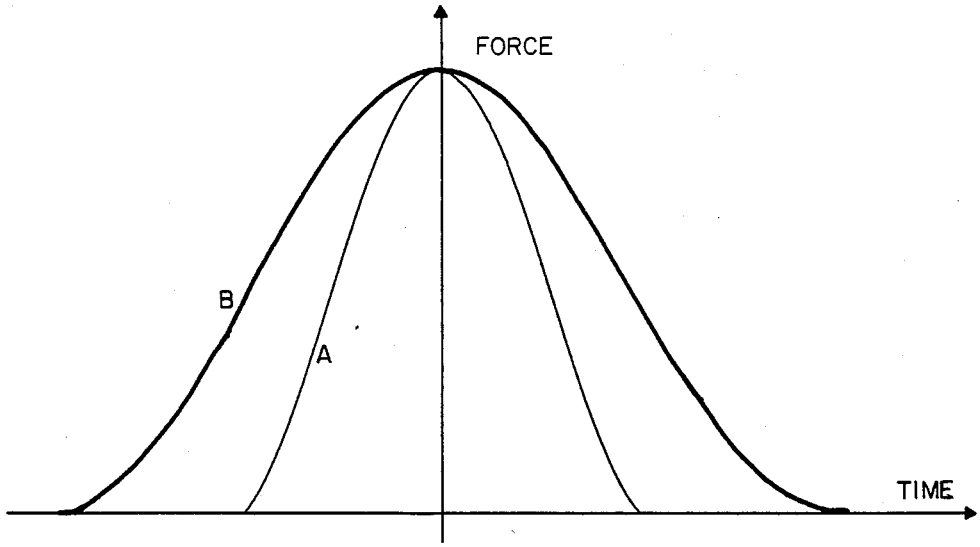
Figure 5:
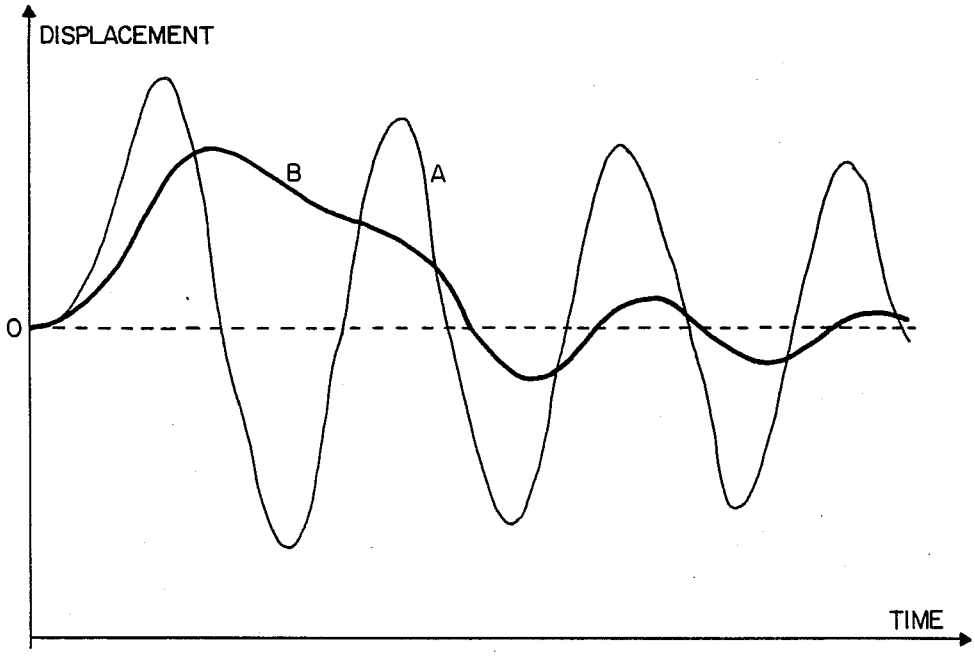

FIG. 4 shows the form of the impulse caused by the passage of the cylinder gap in the case of a usual blanket cylinder (A) and in the case of the use of the damping device according to the invention on the same blanket cylinder (B); and FIG. 5 shows the vibratory response obtained by step-by-step transitory dynamic calculation, in the case of a usual blanket cylinder (A) providing printing defects and in the case of the use of the invention damping device (B) also for a blanket cylinder of offset machines.

DETAILED DESCRIPTION

Figure 1:
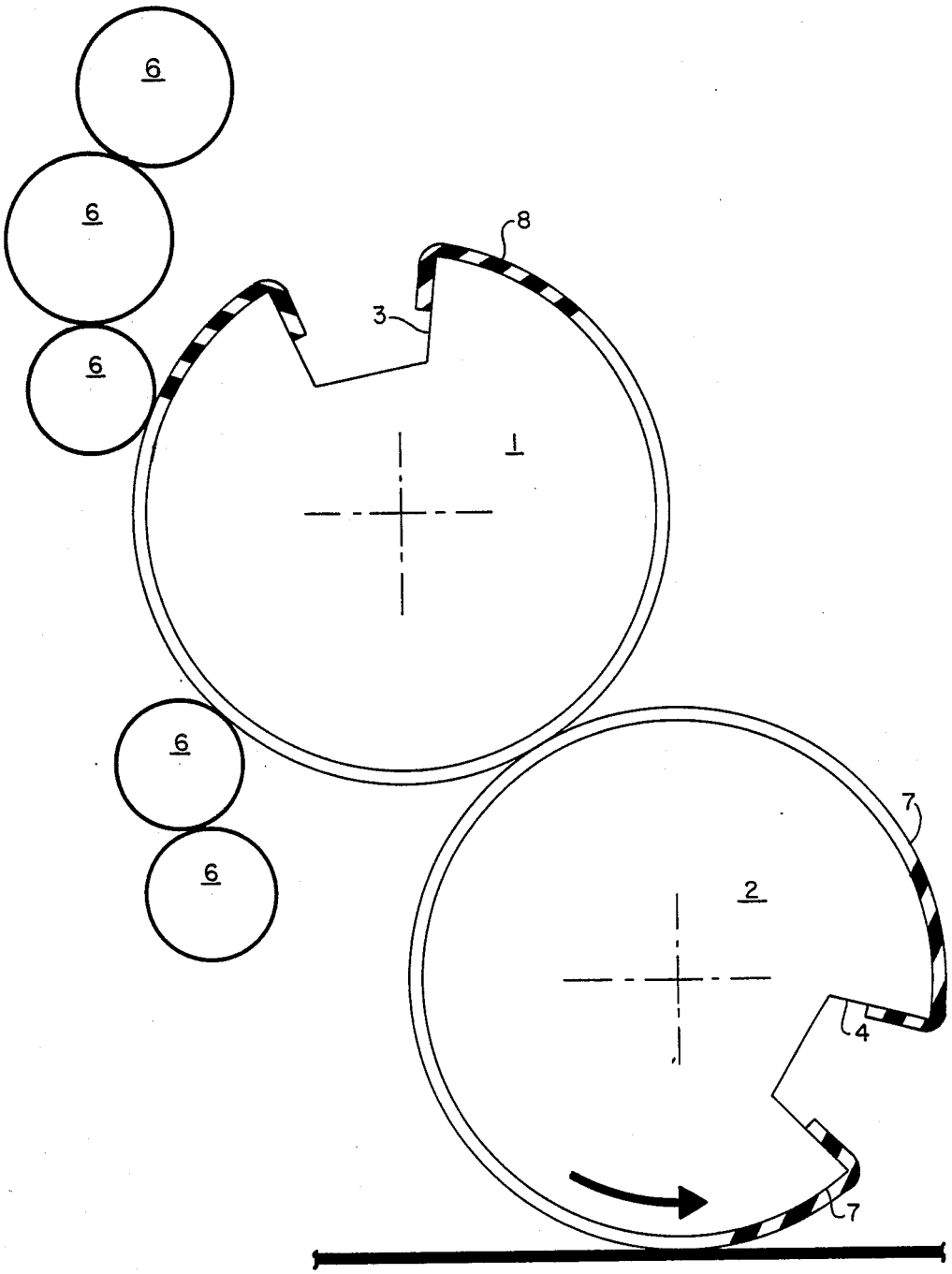
FIG. 1 shows schematically and in transverse cross-section the essential part of an offset printing machine with simple development; the gap being shown oversized for clarity purposes.

FIG. 1 shows a typical offset printing machine.

An offset machine comprises printing blocks constituted by a set of cylinders 1 and 2 and of rolls 6.

Offset printing is based on the balance between two antagonistic fluid films: water and ink, of a thickness ranging between 1 and 3 microns. It consists of transferring an image taken from a plate 8 with trough or relief print fixed onto the respective supporting cyliner 1 through the intermediary of a blanket 7 fixed on a cylinder 2, to a surface such as paper.

The fixing of plate 8 and of blanket 7 to the cylinders is obtained by the use of lock up devices (not shown), embedded in the cylinders, by introducing the plate 8 and blanket 7 in a gap, 3 and 4, respectively provided in each cylinder 1 and 2.

The transfer is obtained by contacting with a regulated specific pressure the various cylinders and rolls.

As previously set forth the quality of printing is conditioned by the regularity of the water and ink films and the constancy of the pressure. Each gap 3, 4, constitutes a constraining discontinuity which generates mechanical vibrations and irregularities. These gaps however are necessary for the mounting and unmounting of plates 8 and blankets 7.

Figure 2:
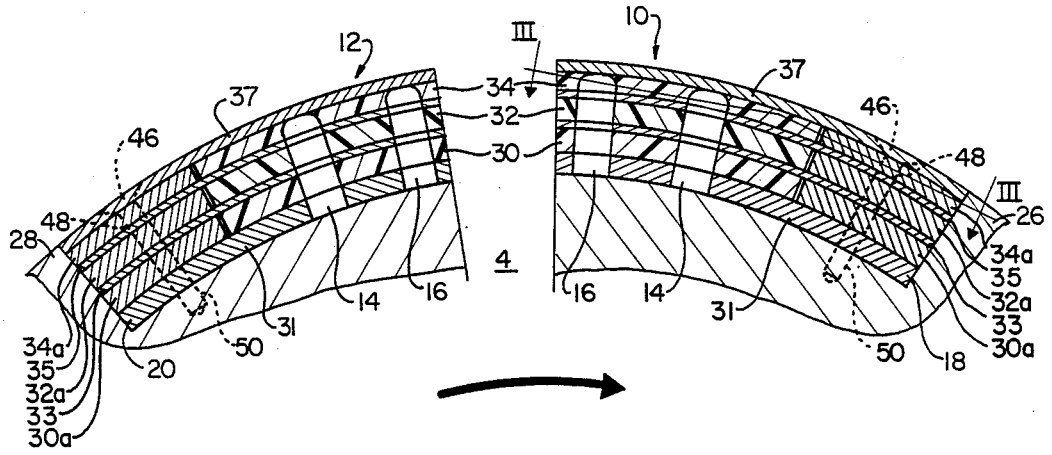
FIG. 2 shows a partial cross-section at the level of the gap of the embodiment shown in FIG. 1.
Figure 3:
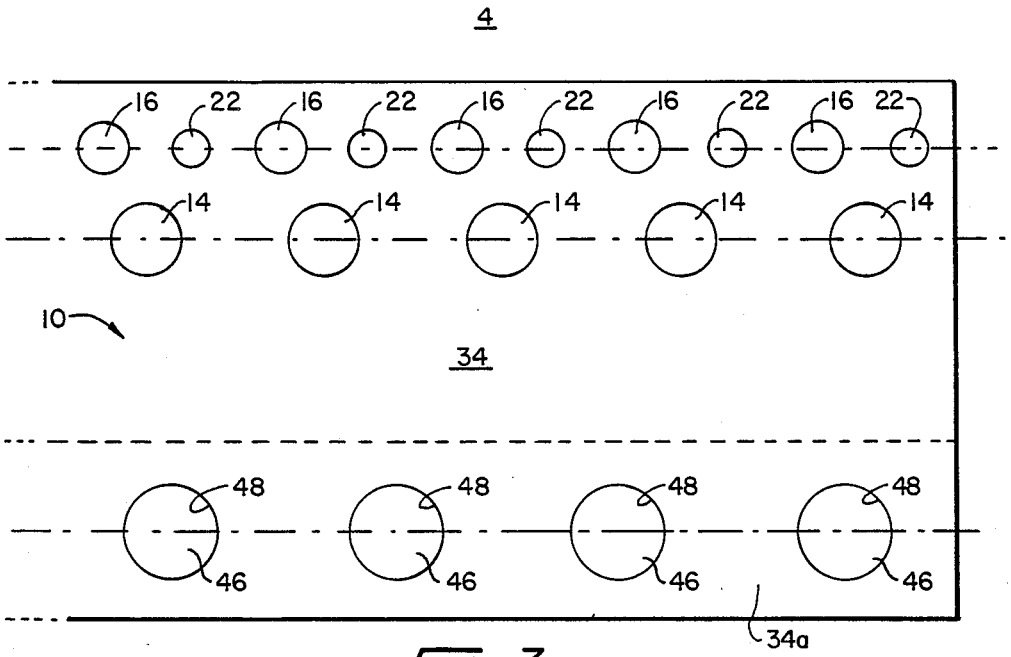
FIG. 3 is a view according to arrows III—III of FIG. 2 of the front edge of the gap.

In reference to FIGS. 2 and 3, it can be seen that such a cylinder, for example 2, which has been modified to include a vibration damping device according to the present invention. One or several damping means 10, 12, are located in one or several appropriate housings 18, 20, at the front edge 26 and/or the rear edge 28 of gap 4.

According to a preferred embodiment, the damping means 10, 12, are inserts in the form of a lamellar or laminated piece formed by the superimposing of layers of appropriate materials bonded together, as can be clearly seen from FIG. 2.

According to another embodiment, some layers 30, 32, and 34, are at least partially formed from materials resilient in compression whereas some other layers or the remaining layers 31, 33, 35 and 37, are at least partially formed from materials rigid in compression. Thus, one zone 30*a*, 32*a*, 34*a* of each layer 30, 32, 34 can be rigid in compression to constitute a transitory zone. This also makes the attachment of the damping means easier.

According to a preferred embodiment, there is a partial or full alternation of the resilient material and the rigid material layers.

The external layer 37 should match the exact dimensions of the cylinder and is preferably a rigid material, preferably a metal or similar hard material.

According to another feature of the invention, the housings can also be formed in other sectors of the cylinder. In particular, housings can be on the whole surface of the cylinder or located at a position on the cylinder at which the gap of the adjacent cylinder meets the cylinder during rotation.

The size of the housings and thus of the inserts can vary axially and/or circumferentially so as to form a profile variable im compression rigidity and damping ability.

Different layers of resilient material deformable in compression 30, 32, 34, can be constituted by different materials with a resilient modulus varying from 0.1 MPa to 10,000 MPa and selected from the group of elastomeric materials (cured, thermoplastic or thermostable) or thermocurable, thermoplastic or thermostable polymeric materials, as well as any combinations thereof, having an appropriate modulus and damping ability in the range of temperatures and frequency of use for the machines.

Examples of useful materials include but are not limited to natural rubber, cured or uncured; nitrile polymers; polychloroprene polymers; butyl polymers; polyvinyl chloride polymers; silicone polymers; polybutadiene polymers; polyethylene polymers; epoxy resins; phenolic resins; polyimides; polyesters; and copolymers or mixtures thereof.

Of course, the layers of the resilient materials can be formed with elastomers or polymers having different moduli and damping capacities whereas the resilient material itself can be a combination of an arbitrary number of different elastomeric and polymeric materials, this being particularly useful in the circumferential sense. The resilient material can be cellular or alveolar.

Also, the rigid material of the layers 31, 33, 35, 37 can be formed of a metal or a metallic alloy, or a structural composite or a fibrous reinforcement such as a cloth, mat or combinations of these materials.

Examples of suitable materials include but are not limited to sheet metal and foils; fiberglass mats, (impregnated and unimpregnated); wire mesh; plastic sheets or meshes; and hard epoxy orphenolic resins.

Of course, as previously set forth, these different layers can be bonded together so as to constitute a single laiminated insert.

In FIGS. 2 and 3, another preferred embodiment is shown. Orifices, such as 14, 16, and 22 are formed in the damping means and contain material having damping abilities which differ from that of the surrounding material. The diameter size of the orifices 14, 16, 22 can vary widely and is not essential to the invention. The orifices may also be varied in position in the housings as shown in FIG. 3. Furthermore, the shape of the orifices can be of any shape, but it is preferred, for purposes of simple geometry and manufacturing costs, that the orifices 14, 16, 22 have a circular cross-section and by cylindrical in form.

A further embodiment is the ability to set at will the absolute value in the axial and/or circumferential sense of the compression rigidity modulus by the presence of orifices in the insert such as orifices 14, 16, 22, shown in FIGS. 2 and 3. The orifices may extend at least through a portion of the insert except for the external layer, as shown.

The inserts may also be pre-stressed in compression to improve the dynamic performance.

The inserts are fixed rigidly to the housings by an appropriate means, for instance through the use of embedded screws going through appropriate orifices 48, and reaching blind holes 50 in the cylinder.

After fixing the inserts on the cylinder, the insert surfaces are then rectified to the exact and very precise dimensions required for the specific machine. This most often required only alignments of the inserts. However, the inserts if necessary may be shaped, cut or ground to fit.

It can therefore be understood that, with the present invention, a minor modification to the machine cylinders may be required so that the invention can be mounted without problems onto the existing machine cylinders.

This invention is applicable to the plate cylinders and/or the blanket cylinders and generally to any rotating cylinder provided with a gap, in particular on offset machines, on flexographic machines and other machines, such as typographic printing machines.

In FIG. 4, the shape of the vibration impulse caused by the passage of the gaps in the usual case A and in the case of the present invention B on a blanket cylinder 2 is shown. It clearly shows the essential difference achieved with the present invention. The present invention achieves a graduated variation in rigidity in the circumferential sense allowing one to modify the shape of the impulse at will and furthermore to improve the vibratory response at will, thereby obtaining a significant improvement in damping.

FIG. 5 shows the vibratory response obtained by a stepwise transitory dynamic calculation, in the usual case, curve A forming printing defects and in the case of the use of the present damping device, curve B for a blanket cylinder 2 of an offset machine. The shape of the curve is clearly decisive.

The present invention therefore provides all the technical advantages previously set forth. It also allows for a modular solution which allows for the use of standardized pieces. The geometry is simple and allows for lower manufacturing costs. The mechanical holding is satisfactory and the fatigue holding is excellent. Improved printing is obtained with practically no defects.

The pressure variation in the nipping zone between the cyinders, generated by the mechanical vibrations, is supported partially by the resilient damping device of the present invention which is very favorable for the regularity in printing.

While this invention has been described with reference to its preferred embodiments, other embodiments can achieve the same result. Variations and modifications of the present invention will be obvious to those skilled in the art and it is intended to cover in the appended claims all such modifications and equivalents as fall within the true spirit and scope of this invention.

What we claimed is:

1. In a rotating cylinder having a gap with a front edge and a rear edge, a damping device comprised of a housing and an insert, the housing being a recess formed in the cylinder surface adjacent an edge of the gap the improvement comprising the insert being a laminated piece formed by the super-imposing of a first resilient layer selected from the group consisting of natural rubber, cured or uncured, nitrile polymers, polychloroprene polymers, butyl polymers, polyvinyl chloride polymers, silicone polymers, polybutadiene polymers, polyethylene polymers, epoxy resins, phenolic resins, polyimides, polyesters, and copolymers or mixtures thereof, and a second rigid layer selected from the group consisting of sheet metal and foils, fiberglass mats, wire mesh, plastic sheets, plastic meshes, hard epoxy resins and hard phenolic resins further comprising one or more orifices formed in and through at least a portion of the insert, the one or more orifices having additional damping materials inserted into them, the additional materials having damping properties different from that of the first resilient layer and second rigid layer of the insert.

2. In a damping device for rotating cylinders having a gap having a front edge and rear edge, a first housing adjacent the front edge of the gap, a second housing adjacent the rear edge of the gap, the first and second housings being recesses formed in a surface of the cylinder adjacent the front and rear edges of the gap, the first and second housings extending around an outer circumferential surface of the cylinder, the first and second housings having an insert affixed to the housings, the improvement comprising the insert being formed of a laminate of damping materials, the laminate being formed of alternating layers of resilient layers and rigid layers, the insert having one or more orifices extending through at least a portion of the insert, the one or more orifices being inserted with additional damping materials, wherein the additional materials have damping properties different from those of insert.

* * * * *